US010329931B2

(12) United States Patent
Hayford et al.

(10) Patent No.: US 10,329,931 B2
(45) Date of Patent: Jun. 25, 2019

(54) STATOR ASSEMBLY FOR A GAS TURBINE ENGINE

(71) Applicant: United Technologies Corporation, Hartford, CT (US)

(72) Inventors: Richard K. Hayford, Cape Neddick, ME (US); Philip Robert Rioux, North Berwick, ME (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 900 days.

(21) Appl. No.: 14/853,202

(22) Filed: Sep. 14, 2015

(65) Prior Publication Data

US 2016/0097291 A1 Apr. 7, 2016

Related U.S. Application Data

(60) Provisional application No. 62/058,389, filed on Oct. 1, 2014.

(51) Int. Cl.
*F01D 9/04* (2006.01)
*F01D 11/00* (2006.01)

(52) U.S. Cl.
CPC ..... *F01D 9/041* (2013.01); *F01D 11/001* (2013.01); *F05D 2250/294* (2013.01); *F05D 2260/941* (2013.01); *F05D 2270/114* (2013.01)

(58) Field of Classification Search
None
See application file for complete search history.

(56) References Cited

U.S. PATENT DOCUMENTS

| | | | | |
|---|---|---|---|---|
| 4,431,373 | A | 2/1984 | Monsarrat | |
| 4,897,021 | A | 1/1990 | Chaplin et al. | |
| 5,154,577 | A * | 10/1992 | Kellock | F01D 11/005 277/641 |
| 5,346,362 | A * | 9/1994 | Bonner | F01D 11/005 415/119 |
| 5,785,492 | A | 7/1998 | Belsom et al. | |
| 6,808,364 | B2 | 10/2004 | O'Reilly et al. | |
| 7,488,157 | B2 * | 2/2009 | Marini | F01D 5/147 416/193 A |
| 7,837,435 | B2 | 11/2010 | Ellis et al. | |
| 8,206,094 | B2 | 6/2012 | Seki et al. | |
| 8,240,043 | B2 | 8/2012 | Duesler et al. | |
| 8,398,366 | B2 | 3/2013 | Twell | |
| 2010/0150710 | A1 * | 6/2010 | Khanin | F01D 9/041 415/208.1 |
| 2011/0135479 | A1 | 6/2011 | Ueda et al. | |
| 2013/0101395 | A1 | 4/2013 | Miller et al. | |

* cited by examiner

*Primary Examiner* — Kayla McCaffrey
(74) *Attorney, Agent, or Firm* — Carlson, Gaskey & Olds, P.C.

(57) ABSTRACT

A stator assembly includes a platform located on a radially inner end of a plurality of vanes that connects a first vane to a second vane. There is a platform groove on a radially inner side of the platform between the first vane and the second vane.

18 Claims, 3 Drawing Sheets

STATOR ASSEMBLY FOR A GAS TURBINE ENGINE

CROSS-REFERENCE TO RELATED APPLICATIONS

This application claims priority to U.S. Provisional Application No. 62/058,389, which was filed on Oct. 1, 2014 and is incorporated herein by reference.

BACKGROUND

A gas turbine engine typically includes a fan section, a compressor section, a combustor section, and a turbine section. Air entering the compressor section is compressed and delivered into the combustion section where it is mixed with fuel and ignited to generate a high-speed exhaust gas flow. The high-speed exhaust gas flow expands through the turbine section to drive the compressor and the fan section.

The compressor section for the gas turbine engine generally includes a rotor assembly and a stator vane assembly. The rotor assembly includes rows or arrays of rotor blades. The arrays of rotor blades extend radially outward across a gas path. The stator vane assembly includes arrays of stator vanes axially separating each of the arrays of rotor blades. The arrays of stator vanes extend inward from a radially outward case across the gas path into proximity with the rotor assembly. The arrays of stator vanes guide a working flow medium through the gas path as the working flow medium is discharged from each of the arrays of rotor blades.

A significant amount of effort is placed on increasing the efficiency of the gas turbine engine. One way to increase the efficiency of the gas turbine engine is to decrease the amount of compressor air that leaks from the compressor section. In order to reduce unwanted air leaks from the compressor section, various seals are incorporated into the compressor section to prevent the compressed air from leaking out. One type of seal used is a knife edge seal. Knife edge seals create a region with a pressure drop to deter compressed air from leaking past the seal. However, leakage occurs in other locations, such as between vanes. Therefore, there is a need for a compressor section with that reduces the loss of compressed air.

SUMMARY

In one exemplary embodiment, a stator assembly includes a platform located on a radially inner end of a plurality of vanes that connects a first vane to a second vane. There is a platform groove on a radially inner side of the platform between the first vane and the second vane.

In a further embodiment of the above, a radially outer side of the platform is continuous between the first vane and the second vane.

In a further embodiment of any of the above, a bridge portion extends along a distal end of the platform groove and includes a crack.

In a further embodiment of any of the above, the crack extends between a radially inner side of the bridge portion and a radially outer side of the bridge portion.

In a further embodiment of any of the above, the bridge portion extends along at least one of a leading edge and a trialing edge of the platform.

In a further embodiment of any of the above, the platform groove extends between approximately 5% and 20% of the thickness of the platform.

In a further embodiment of any of the above, the platform includes a leading edge and a trailing edge. The platform groove is spaced axially inward from the leading edge and the trailing edge.

In a further embodiment of any of the above, the platform groove includes a component that extends in an axial direction and a circumferential direction.

In a further embodiment of any of the above, a damper extends around the platform.

In another exemplary embodiment, a stator assembly for a gas turbine engine includes a platform that is located on a radially inner end of a plurality of vanes. A platform groove is on a radially inner side of the platform between a first vane and a second vane. A bridge portion extends along a distal end of the platform groove and includes a crack.

In a further embodiment of any of the above, the crack extends between a radially inner side of the bridge portion and a radially outer side of the bridge portion.

In a further embodiment of any of the above, the groove extends between approximately 5% and 20% of the thickness of the platform.

In a further embodiment of any of the above, the platform includes a leading edge and a trailing edge. The platform groove is spaced axially inward from the leading edge and the trailing edge.

In a further embodiment of any of the above, a damper extends around the platform.

In a further embodiment of any of the above, the bridge portion extends along a leading edge and a trialing edge of the platform.

In one exemplary embodiment, a method of forming a stator assembly includes forming a plurality of vanes with a platform located on a radially inner end, forming a platform groove between a first vane and a second vane and forming a bridge portion that extends along a distal end of the platform groove.

In a further embodiment of the above, the method includes cracking the bridge portion.

In a further embodiment of any of the above, the platform groove is located on a radially inner side of the platform. A radially outer side of the platform is continuous between the first vane and the second vane.

In a further embodiment of any of the above, the platform groove is formed by electro-discharge machining.

In a further embodiment of any of the above, the bridge portion extends along a leading edge and a trialing edge of the platform.

DETAILED DESCRIPTION

Figure 1:
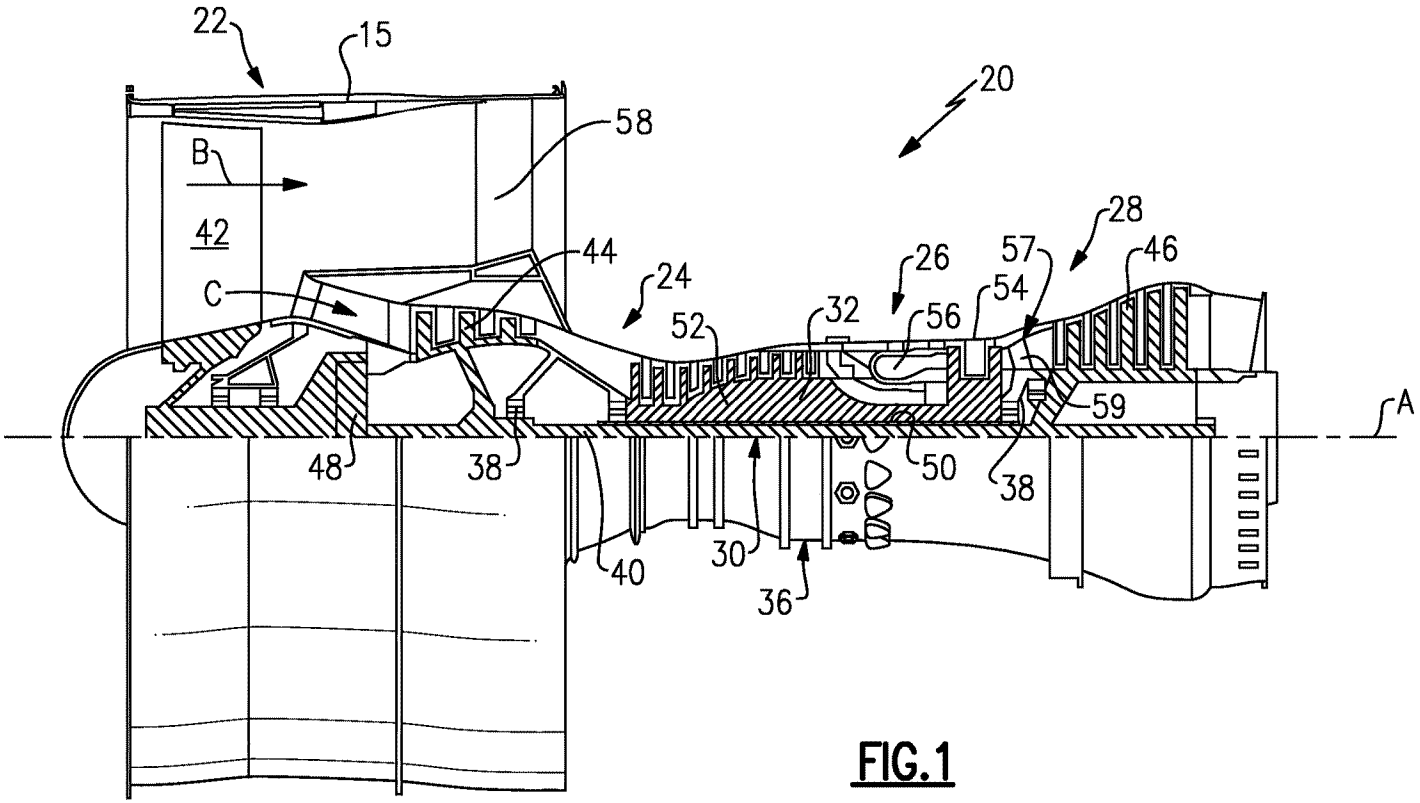
FIG. 1 is a schematic view of an example gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines might include an augmentor section (not shown) among other systems or features. The fan section 22 drives air along a bypass flow path B in a bypass duct defined within a nacelle 15, while the compressor section 24 drives air along a core flow path C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects a fan 42, a first (or low) pressure compressor 44 and a first (or low) pressure turbine 46. The inner shaft 40 is connected to the fan 42 through a speed change mechanism, which in exemplary gas turbine engine 20 is illustrated as a geared architecture 48 to drive the fan 42 at a lower speed than the low speed spool 30. The high speed spool 32 includes an outer shaft 50 that interconnects a second (or high) pressure compressor 52 and a second (or high) pressure turbine 54. A combustor 56 is arranged in exemplary gas turbine 20 between the high pressure compressor 52 and the high pressure turbine 54. A mid-turbine frame 57 of the engine static structure 36 is arranged generally between the high pressure turbine 54 and the low pressure turbine 46. The mid-turbine frame 57 further supports bearing systems 38 in the turbine section 28. The inner shaft 40 and the outer shaft 50 are concentric and rotate via bearing systems 38 about the engine central longitudinal axis A which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The mid-turbine frame 57 includes airfoils 59 which are in the core airflow path C. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of combustor section 26 or even aft of turbine section 28, and fan section 22 may be positioned forward or aft of the location of gear system 48.

The engine 20 in one example is a high-bypass geared aircraft engine. In a further example, the engine 20 bypass ratio is greater than about six (6), with an example embodiment being greater than about ten (10), the geared architecture 48 is an epicyclic gear train, such as a planetary gear system or other gear system, with a gear reduction ratio of greater than about 2.3 and the low pressure turbine 46 has a pressure ratio that is greater than about five. In one disclosed embodiment, the engine 20 bypass ratio is greater than about ten (10:1), the fan diameter is significantly larger than that of the low pressure compressor 44, and the low pressure turbine 46 has a pressure ratio that is greater than about five 5:1. Low pressure turbine 46 pressure ratio is pressure measured prior to inlet of low pressure turbine 46 as related to the pressure at the outlet of the low pressure turbine 46 prior to an exhaust nozzle. The geared architecture 48 may be an epicycle gear train, such as a planetary gear system or other gear system, with a gear reduction ratio of greater than about 2.3:1. It should be understood, however, that the above parameters are only exemplary of one embodiment of a geared architecture engine and that the present disclosure is applicable to other gas turbine engines including direct drive turbofans.

A significant amount of thrust is provided by the bypass flow B due to the high bypass ratio. The fan section 22 of the engine 20 is designed for a particular flight condition—typically cruise at about 0.8 Mach and about 35,000 feet. The flight condition of 0.8 Mach and 35,000 ft (10,668 meters), with the engine at its best fuel consumption—also known as "bucket cruise Thrust Specific Fuel Consumption ('TSFC')"—is the industry standard parameter of lbm of fuel being burned divided by lbf of thrust the engine produces at that minimum point. "Low fan pressure ratio" is the pressure ratio across the fan blade alone, without a Fan Exit Guide Vane ("FEGV") system 58. The low fan pressure ratio as disclosed herein according to one non-limiting embodiment is less than about 1.45. "Low corrected fan tip speed" is the actual fan tip speed in ft/sec divided by an industry standard temperature correction of $[(\text{Tram } °R)/(518.7° R)]^{0.5}$. The "Low corrected fan tip speed" as disclosed herein according to one non-limiting embodiment is less than about 1150 ft/second (350.5 meters/second).

Figure 2:
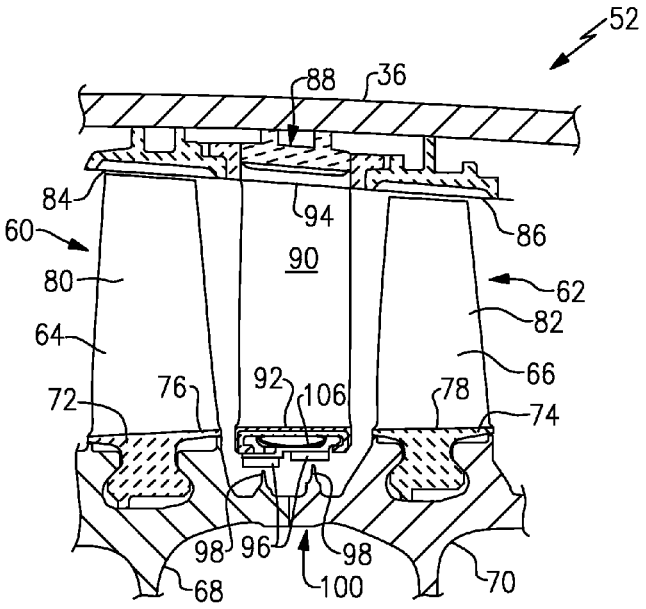
FIG. 2 is an enlarged schematic cross-section of a high pressure compressor section for the gas turbine engine of FIG. 1.

FIG. 2 illustrates an enlarged schematic view of the high pressure compressor 52, however, other sections of the gas turbine engine 20 could benefit from this disclosure. The high pressure compressor 52 includes multiple stages, however, only a first rotor assembly 60 and a second rotor assembly 62 are shown in the illustrated example. The first rotor assembly 60 and the second rotor assembly 62 are attached to the outer shaft 50 (FIG. 1).

The first rotor assembly 60 includes a first array of rotor blades 64 circumferentially spaced around a first disk 68 and the second rotor assembly 62 includes a second array of rotor blades 66 circumferentially spaced around a second disk 70. Each of the first and second array of rotor blades 64, 66 include a respective first and second root portion 72, 74, a first and second platform 76, 78, and a first and a second airfoil 80, 82. Each of the first and second root portions 72, 74 is received within a respective one of the first and second disks 68, 70. The first airfoil 80 and the second airfoil 82 extend radially outward toward a first and second blade outer air seal (BOAS) assembly 84, 86, respectively.

Alternatively, the first rotor assembly 60 or the second rotor assembly 62 could be an integrally bladed rotor assembly with the first and second airfoils 80, 82 formed integrally with the respective first and second disks 68, 70, without a separate first and second root portion 72, 74 or a separate first and second platform 76, 78, respectively.

A shroud assembly 88 within the engine case structure 36 between the first rotor assembly 60 and the second rotor assembly 62 directs the core airflow in the core flow path from the first array of rotor blades 64 to the second array of rotor blades 66. The shroud assembly 88 may at least partially support the first and second blade outer air seals 84, 86 and include an array of vanes 90 that extend between a respective inner vane platform 92 and an outer vane platform 94. The outer vane platform 94 may be supported by the engine case structure 36 and the inner vane platform 92 supports abradable annular seals 96, such as a honeycomb, to seal the core airflow in the axial direction with respect to knife edges 98 on a seal assembly 100.

Figure 3:
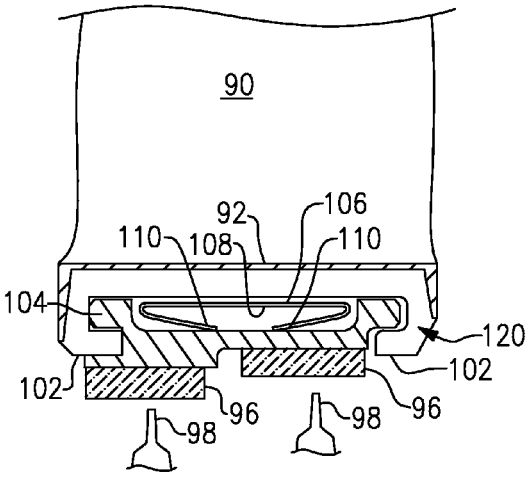
FIG. 3 is an enlarged view of a vane platform of FIG. 2.

FIG. 3 shows an enlarged view of the inner vane platform 92 along with a portion of the vane 90. The inner vane platform 92 includes a pair of protrusions 102 that retain an inner diameter air seal carrier 104 that supports the abradable annular seals 96. An inner diameter platform spring 106 radially loads the inner diameter air seal carrier 104 against the pair of protrusions 102 to control vibratory response of the vane 90 with frictional damping. In the illustrated example, the inner diameter platform spring 106 includes a mid-portion 108 that abuts the inner vane platform 92 and flexible ends 110 that bend over the mid-portion 108 and abut the inner diameter air seal carrier 104 to provide a biasing force that damps vibrations. In another example, the inner diameter platform spring 106 could include only a single flexible end 110.

Figure 4:
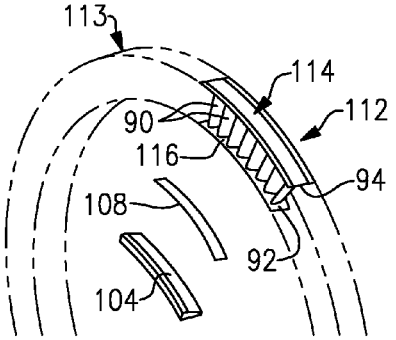
FIG. 4 is a schematic view of a vane segment.

FIG. 4 illustrates a vane segment 112 with a plurality of the vanes 90 forming a portion of a stator ring 113 (shown in dashed lines). The outer vane platforms 94 of the vanes 90 are attached together circumferentially and form an outer diameter shroud 114. The outer diameter shroud 114 extends continuously such that at least a portion of the outer vane platform 94 between adjacent vanes 90 is free of gaps. The inner vane platforms 92 of the vanes 90 are attached together circumferentially and form an inner diameter shroud 116. The inner diameter shroud 116 extends continuously such that at least a portion of the inner vane platform 92 between adjacent vanes 90 is free of gaps.

Figure 5:
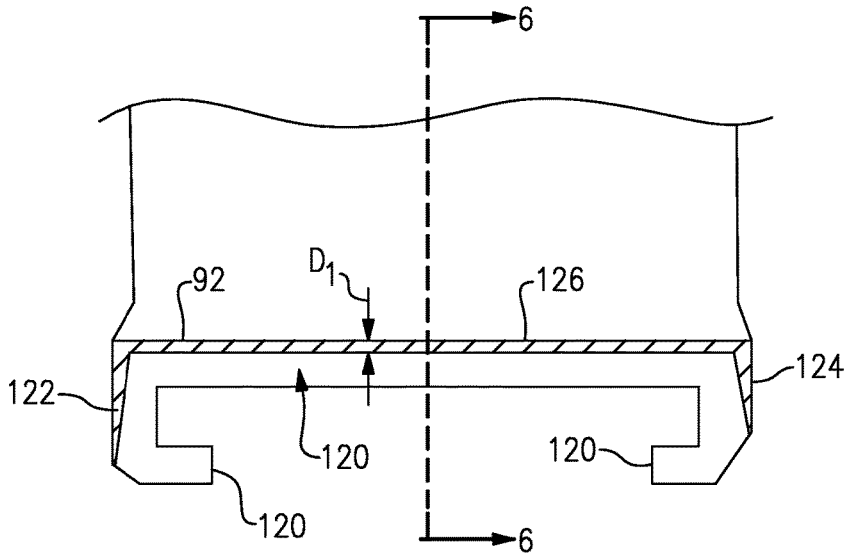
FIG. 5 is another enlarged view of the vane platform.

As shown in FIG. 5, a groove 120 is formed in the inner vane platform 92. The groove 120 extends through a substantial portion of the inner vane platform 92. In the illustrated example, the groove 120 extends to a leading edge 122 and a trailing edge of the inner vane platform 92. A bridge portion 126 extends along a radially outer portion of the inner vane platform 92 and onto the leading edge 122 and the trailing edge 124. The bridge portion 126 includes an example non-limiting thickness D1 of approximately 0.010 inches to 0.020 inches (0.254 mm to 0.508 mm).

The vanes 90 can be cast, fabricated, or machined as a single ring or segments of a ring as shown in FIG. 4. The groove 120 is formed in the inner vane platform 92 between adjacent vanes 90 through a machining process, such as electro-discharge machining (EDM) with a thin plate electrode in the shape of the groove 120. Alternatively, the groove 120 could be formed without additional machining if the vanes 90 were produced with an additive manufacturing process. In the illustrated example, the groove 120 extends at least 50% through a thickness of the inner vane platform 92. In another example, the groove 120 extends between approximately 5% and 20% of the thickness of the inner vane platform 92.

Figure 6:
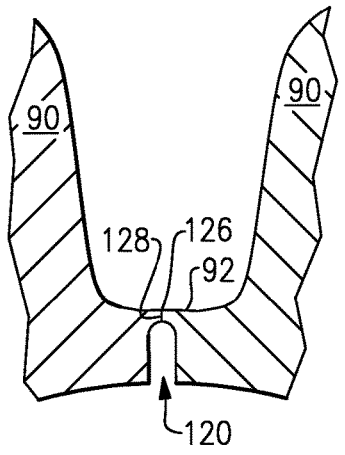
FIG. 6 is a cross-section taken along line 6-6 of FIG. 5.

As shown in FIG. 6, a crack 128 can form in the bridge portion 126 in the inner vane platform 92 adjacent a distal end of the groove 120. A radius of the distal end of the groove 120 can function as a crack initiation site so that the crack 128 will form from the distal end and extend radially outward until the crack 128 reaches a radially outer diameter of the inner vane platform 92. The crack 128 could be parallel to the engine axis "A" or skewed with some circumferential component relative to the engine axis "A."

The cracks 128 are caused by static or vibratory loads that occur in the vanes 90 under typical operation of the gas turbine engine 20. The thickness D1 of the bridge 126 is designed so as not to be able to withstand these loads without forming the cracks 128.

The crack 128 will allow for relative movement between adjacent vanes 90 while providing the smallest possible circumferential gap because opposing surfaces of the crack 128 form nearly perfect matching faces. Because the crack 128 will allow for the smallest possible circumferential gap in the inner vane platform 92, less compressed air will leak past the inner vane platform 92 and increase the performance of the gas turbine engine 20.

Additionally, by forming the groove 120 with an EDM having a draft angle along the leading edge 122 and trialing edge 124 that forms a sharp point at the radially inner end of the bridge portion 126, crack propagation along the bridge portion 126 is promoted.

The preceding description is exemplary rather than limiting in nature. Variations and modifications to the disclosed examples may become apparent to those skilled in the art that do not necessarily depart from the essence of this disclosure. The scope of legal protection given to this disclosure can only be determined by studying the following claims.

What is claimed is:

1. A stator assembly comprising:

a platform located on a radially inner end of a plurality of vanes connecting a first vane to a second vane; and a platform groove on a radially inner side of the platform between the first vane and the second vane, wherein the platform groove is spaced from a radially outer side of the platform; and a bridge portion extending along a distal end of the platform groove and including a crack, wherein the crack extends between a radially inner side of the bridge portion and a radially outer side of the bridge portion.

2. The assembly of claim 1, wherein the crack extends between a radially inner side of the bridge portion and a radially outer side of the bridge portion.

3. The assembly of claim 1, wherein the bridge portion extends to at least one of a leading edge and a trailing edge of the platform.

4. The assembly of claim 1, wherein the platform groove extends between approximately 5% and 20% of the thickness of the platform.

5. The assembly of claim 1, wherein the platform includes a leading edge and a trailing edge and the platform groove is spaced axially inward from the leading edge and the trailing edge.

6. The assembly of claim 1, wherein the platform groove includes a component extending in an axial direction and a circumferential direction.

7. The assembly of claim 1, including a damper extending around the platform.

8. The assembly of claim 1, wherein the crack extends from a radially outer side of the groove through the bridge portion to the radially outer side of the platform.

9. A stator assembly for a gas turbine engine comprising:

a platform located on a radially inner end of a plurality of vanes;

a platform groove on a radially inner side of the platform between a first vane and a second vane; and a bridge portion extending along a distal end of the platform groove and including a crack wherein the crack extends between a radially inner side of the bridge portion and a radially outer side of the bridge portion.

10. The gas turbine engine of claim 9, wherein the groove extends between approximately 5% and 20% of the thickness of the platform.

11. The gas turbine engine of claim 9, wherein the platform includes a leading edge and a trailing edge and the platform groove is spaced axially inward from the leading edge and the trailing edge.

12. The gas turbine engine of claim 9, including a damper extending around the platform.

13. The gas turbine engine of claim 9, wherein the bridge portion extends along a leading edge and a trailing edge of the platform.

14. The gas turbine engine of claim 9, wherein the crack extends from a radially outer side of the groove through the bridge portion to the radially outer side of the platform.

15. A method of forming a stator assembly comprising:

forming a plurality of vanes with a platform located on a radially inner end;

forming a platform groove between a first vane and a second vane, wherein the platform groove is spaced from a radially outer side of the platform and the platform groove is located on a radially inner side of the platform;

forming a bridge portion in the platform extending along a distal end of the platform groove; and cracking the bridge portion.

16. The method of claim 15, further comprising cracking the bridge portion.

17. The method of claim 15, wherein the platform groove is formed by electro-discharge machining.

18. The method of claim 15, wherein the bridge portion extends to a leading edge and a trailing edge of the platform.

* * * * *